US006059479A

United States Patent [19]

Clune

[11] Patent Number: 6,059,479

[45] Date of Patent: May 9, 2000

[54] POP-OUT ELECTRODE ASSEMBLY

[75] Inventor: Thomas Clune, Levittown, N.Y.

[73] Assignee: Ensign Ribbon Burners, LLC, Pellham, N.Y.

[21] Appl. No.: 09/042,413

[22] Filed: Mar. 13, 1998

[51] Int. Cl.[7] ..... F23Q 3/00

[52] U.S. Cl. ..... 403/24; 403/DIG. 6; 431/258

[58] Field of Search ..... 431/258, 264, 431/266; 403/24, 327, 328, 355, 356, 362, 365, 366, DIG. 4, DIG. 6

[56] References Cited

U.S. PATENT DOCUMENTS

| | | | |
|---|---|---|---|
| 1,496,596 | 6/1924 | Phelan | 431/258 X |
| 2,806,518 | 9/1957 | Poole et al. . | |
| 2,881,363 | 4/1959 | D'Luzansky . | |
| 3,352,346 | 11/1967 | Temple . | |
| 4,154,573 | 5/1979 | Dietz | 431/266 |
| 4,177,034 | 12/1979 | Jones . | |
| 4,261,788 | 4/1981 | McClung | 403/DIG. 6 |
| 4,464,107 | 8/1984 | Boe | 431/264 |
| 4,846,671 | 7/1989 | Kwiatek . | |
| 4,854,857 | 8/1989 | Houtman . | |
| 4,960,344 | 10/1990 | Geisthoff et al. | 403/328 X |
| 5,112,218 | 5/1992 | Sigler . | |
| 5,160,255 | 11/1992 | Sigler . | |
| 5,160,256 | 11/1992 | Riehl . | |
| 5,393,224 | 2/1995 | Allen et al. . | |
| 5,464,345 | 11/1995 | Kwiatek . | |

*Primary Examiner*—Terry Lee Melius
*Assistant Examiner*—Greg Binda
*Attorney, Agent, or Firm*—Woodbridge & Associates, P.C.; Richard C. Woodbridge

[57] ABSTRACT

An igniter electrode assembly for gas ignition of an oven burner includes a pop-in and pop-out feature that allows for the easy installation, removal, and replacement of an igniter electrode. The feature allows maintenance access to the igniter electrode without any tools or the need to disassemble the burner assembly. A bushing surrounds the igniter electrode and is held in position by set screws. Ball plungers screwed into the burner plate guide the bushing along keyways in the bushing surface. The ball plungers securely snap into recesses located at the end of the keyways. The invention allows for precision positioning of the igniter electrode tip and repeatability of positioning without having to readjust the igniter electrode or the bushing.

7 Claims, 3 Drawing Sheets

POP-OUT ELECTRODE ASSEMBLY

BACKGROUND OF THE INVENTION

1. Field of the Invention

This invention relates to a device that facilitates the removal and replacement of gas oven burner igniter electrodes.

2. Description of Related Art

There are several problems with the installation, removal, replacement, and servicing of conventional gas oven igniter electrodes. A first problem is debris which makes it difficult to remove the igniter electrode. The problem is associated with prior art systems that use an igniter electrode mounted to a burner plate which is then mounted to an oven with hex screws. The hex screw keyholes accumulate dirt and various other debris from the oven. Clogged hex or Allen keyholes are hard to clean. The clogged key holes also make removal, replacement and servicing of an igniter electrode an inconvenient, unpleasant, and time-consuming chore for maintenance personnel.

A second problem relating to rusting is also common. Baking ovens produce substantial amounts of steam based on the foodstuffs being baked. Steam from the baking process rusts the screws holding the igniter electrodes in the oven. Rusted screws make it difficult, if not nearly impossible, to remove the igniter electrodes. The problem usually requires a disproportionate amount of time and effort to remedy in relation to the cost of the part being replaced.

A third problem is that special tools are required to change igniter electrodes. Each oven manufacturer has it's own method of attaching igniter electrodes. Some manufactures use inch pattern hex screws, others use metric hex screws, while still others use various and sundry screws or other fasteners to affix the burner plates to the ovens. Maintenance personnel require a large number of tools in order to perform what should be a simple operation.

One approach to solving the above problems is by using a retaining clip affixed to a sleeve that secures the igniter. U.S. Pat. No. 5,393,224 discloses a system that requires the use of special igniters of a specific diameter and length and having a rimmed characteristic. Only those igniters having this exacting criteria may be used because they are the only ones that will fit in the sleeve. Further, the method requires the use of both hands, one to hold the igniter electrode and the other to lift the clip to remove the igniter electrode. Complex igniter electrode designs require manufacturing changes that reduce the economic benefit recovered from saved maintenance costs by using this prior art system.

U.S. Pat. No. 4,177,034 describes an adjustable bracket assembly that can be employed to hold an igniter electrode in position in a variety of different configurations. The device includes a flat metal stamping having a web with distal apertures bearing upstanding peripheral flanges about each aperture, and two pairs of bendable tabs. The device requires removing the entire burner assembly before removing the igniter electrode. Once the entire assembly is removed maintenance personnel must then use a special tool to remove the snap ring that holds the igniter in place. After the snap ring is detached the igniter can be extracted. An apparatus requiring the removal of the entire burner assembly is not a solution to minimizing the labor needed to replace an igniter electrode.

U.S. Pat. No. 5,464,345 discloses the use of another type of igniter electrode holder for securing an igniter electrode with respect to a gas flame burner. An apparatus that must be completely disassembled to gain access to the burner significantly increases the cost of maintaining the unit. The apparatus requires the burner head assembly to be removed in order to gain access to the igniter electrode. The prior art apparatus was to be used only with special igniter electrodes that have an "L"-shaped form. Similarly, as in other cited prior art devices, no provision is made for easily removing of the igniter.

U.S. Pat. No. 4,846,671 describes the use of a snap in ring to hold the igniter electrode in position. The removal of an igniter electrode from this device requires the use of special tools as well as both hands. Snap rings are not suited to the baking environment because they are prone to rusting. A rusted snap ring can be almost as difficult to remove as a rusted threaded fastener. The problem of convenient, easy installation and removal of igniter electrodes is not solved by this invention.

U.S. Pat. No. 4,854,857 discloses the use of dimples in a sleeve to hold the igniter electrode in position. Only special electrodes which can fit inside the sleeve dimensions and having a special rim feature may be used. The dimensions of the sleeve and the dimples do not allow for flexibility in choosing electrodes. Complex igniter electrodes require manufacturing changes that reduce the economic benefit recovered from saved maintenance costs by using this prior art system. The electrodes once secured require significant force to remove. An apparatus that requires the use of significant force does not lend itself to ease of removal.

U.S. Pat. No. 2,881,363 discloses another type of igniter prior art electrode. According to this design the igniter electrode has a ball fixture mounted in the center of the electrode body.

The burner assembly includes a ball socket receiver integrated into it to receive the igniter electrode. The alternative prior art approach requires the redesign of the igniter electrode and a complex structure incorporated into the burner assembly. Complex structures are not suited for all applications and defeat the economic advantages of standardization.

Of possible general relevance to the invention are U.S. Pat. Nos. 5112,218; 5,160,255; 5,160256; 2,806,518; and 3,352,346. U.S. Pat. No. 5,112,218 is representative of the above cited patents. Employing spring clips is another approach to solving the problem of holding an igniter electrode in place. The spring clip is positioned so that the mounting flange is captive inside the burner housing. For any system or method to be effective, the ease of removal of the igniter electrode is crucial. The designs listed do not allow for ease of accessibility, in the above construction the entire burner must be disassembled.

A practical solution to the problem of installing and removing various standard types of igniter electrodes single handedly without special tools is not found in the prior art.

SUMMARY OF THE INVENTION

Briefly described, the invention comprises an igniter electrode bushing assembly that facilitates the installation, removal, replacement and inspection of a burner igniter electrode through the employment of a pop-in and pop-out feature. The pop-out bushing assembly consists of a bushing and a mating burner mounting plate assembly. The bushing consists of a hollow cylindrical bushing, a set screw, and an igniter electrode. To secure the bushing to the igniter electrode, the bushing is placed over the electrode tip and moved down around the center of the electrode body. The electrode is then fastened in place by a set screw. A set screw is threaded through a hole in the wall of the bushing assembly so that it contacts the electrode physically. Direct contact of the set screw to the electrode prevents movement of the electrode in relation to the bushing.

A bushing assembly contains two keyway slots. The slots start at the shouldered end of the bushing, continue toward the rimmed end, and terminate in ball recesses before reaching a rim at the base of the bushing. A rim is incorporated into the rear of the bushing assembly. The rim prevents over-travel of the bushing when the bushing is mated with the burner mounting plate assembly.

A burner mounting plate assembly consists of a plate with an aperture for the pop-out bushing electrode assembly and an aperture for the gas burner assembly. The bushing aperture contains two threaded holes that receive two ball plungers. The two ball plungers engage the bushing in keyway slots along the outer wall of the bushing. The keyway slots act as a guide for the bushing to facilitate the mating of the bushing into the burner mounting plate aperture. The ball plungers roll along the keyway slots until they reach the end where they are accepted into recesses in the bushing's outer wall. Once at the recesses, the ball plungers pop into place in the recesses and secure the bushing to the mounting plate. Only a small amount of effort is required to pop in and pop-out the bushing. The bushing is now securely held in place, it can be removed, inspected, and replaced without losing the precise angle or zero of the igniter electrode. These and other features of the invention will be more fully understood by reference to the following drawings.

DETAILED DESCRIPTION OF THE PREFERRED EMBODIMENT

During the course of this description like numbers will be used to identify like elements according to the different views that illustrate the invention.

Figure 1:
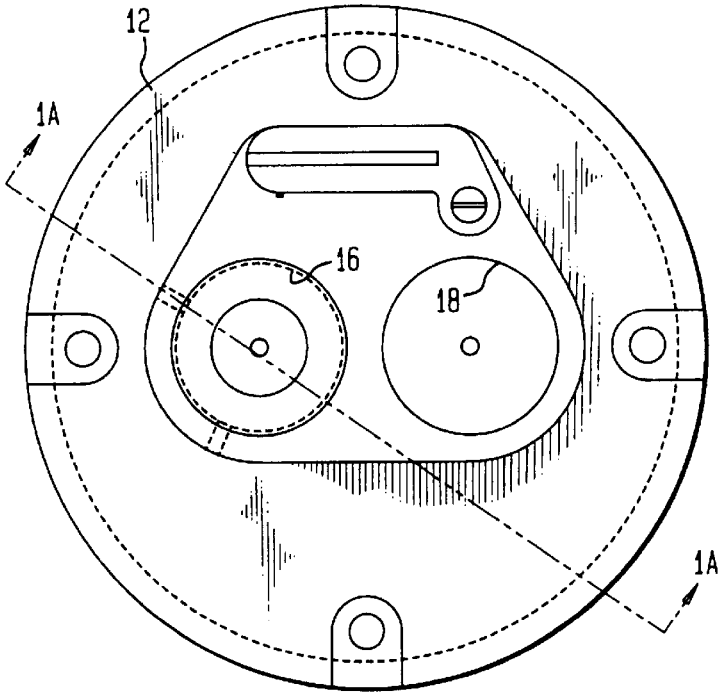
FIG. 1. illustrates a top plan view of the burner mounting plate.

FIG. 1 illustrates a burner mounting plate 12. The mounting plate 12 contains two apertures 18 and 16. Apertures 18 and 16 are respectively for receiving the burner assembly and for the igniter electrode assembly 14. Burner mounting plate 12 further contains a set of threaded apertures 20. The threaded apertures 20 intersect the igniter electrode aperture 16 at perpendicular angles. The purpose of the threaded apertures 20 is to receive screw in ball plungers 24. It is important for the aperture 20 to be formed completely through the wall of the burner plate 12. The ball plungers 24 must extend into the electrode aperture 16. For the ball plungers to be effective, they must be able to make full contact and be adjustable with respect to bushing 10. Burner mounting plate 12 is removably affixed to a conventional oven (not shown) by means of screws located on the outer circumference of the burner mounting plate. By securing the plate 12 to the oven and making components removable there is no need to remove the burner mounting plate from the oven.

Figure 2:
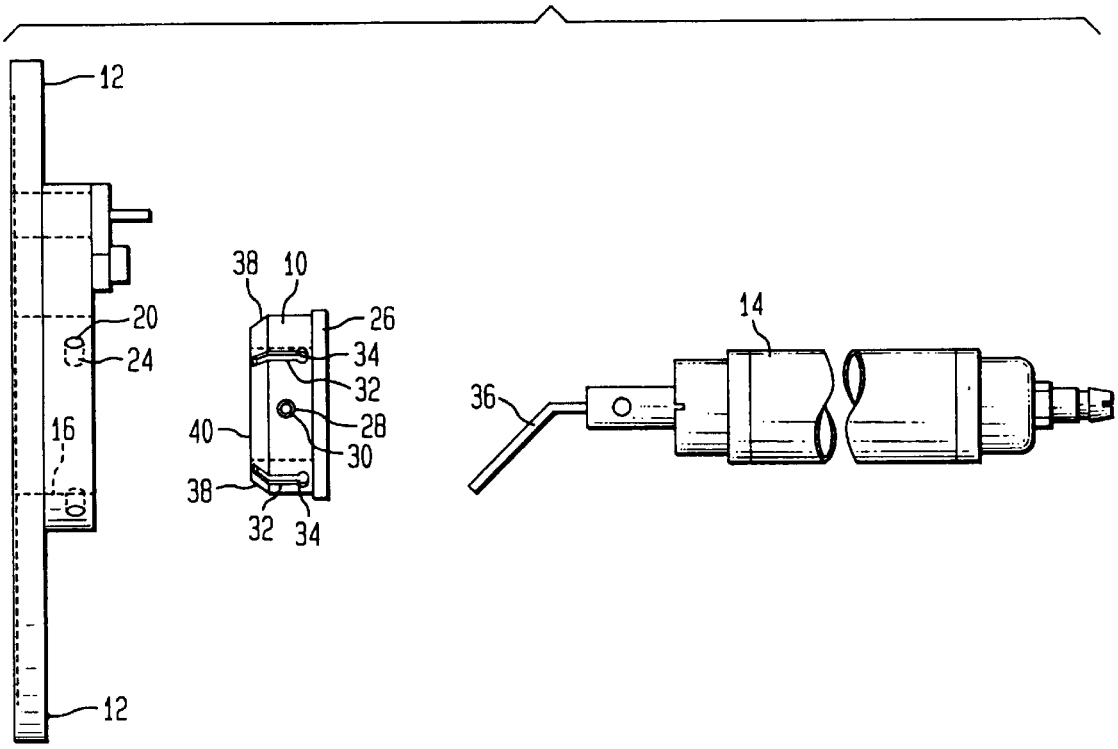
FIG. 2. illustrates a side exploded view of the preferred embodiment of the invention.

The preferred embodiment of the invention 10 is illustrated in FIG. 2 in the context of a pop-out electrode bushing 10 and a burner mounting plate 12. In FIG. 2, note that the electrode tip 36 is placed through the aperture 40 in bushing 10. The bushing 10 is then positioned on the igniter electrode 14. Bushing 10 is positioned so as to achieve the optimum ignition effectiveness for the igniter electrode 14. Once the desired position is obtained, the bushing 10 can be made immovable by a set screw 30. Set screw 30 securely attaches the igniter electrode 14 to the bushing 10. A threaded aperture 28 is located in the longitudinal axis of bushing 10 and extends into the center aperture 40 of bushing 10. Threaded aperture 28 allows the set screw 30 to make contact with the igniter electrode 14. Recesses 34, shoulder 38, and keyways 32 assist bushing 10 to mate with the burner plate 12. Shoulder 38 provides an initial smaller diameter shaft surface which is less than the diameter of the of the burner plate aperture 16 with which it mates. The slope of the shoulder 38 helps to quickly locate and smoothly feed the bushing 10 into the burner mounting plate 12 during mating. The keyways 32 are intended to engage ball plungers 24 which are located in the burner mounting plate 12. Keyways 32 assist in locating the correct position of the rotation of the electrode 14 in relation to the bushing assembly 10.

Figure 3:
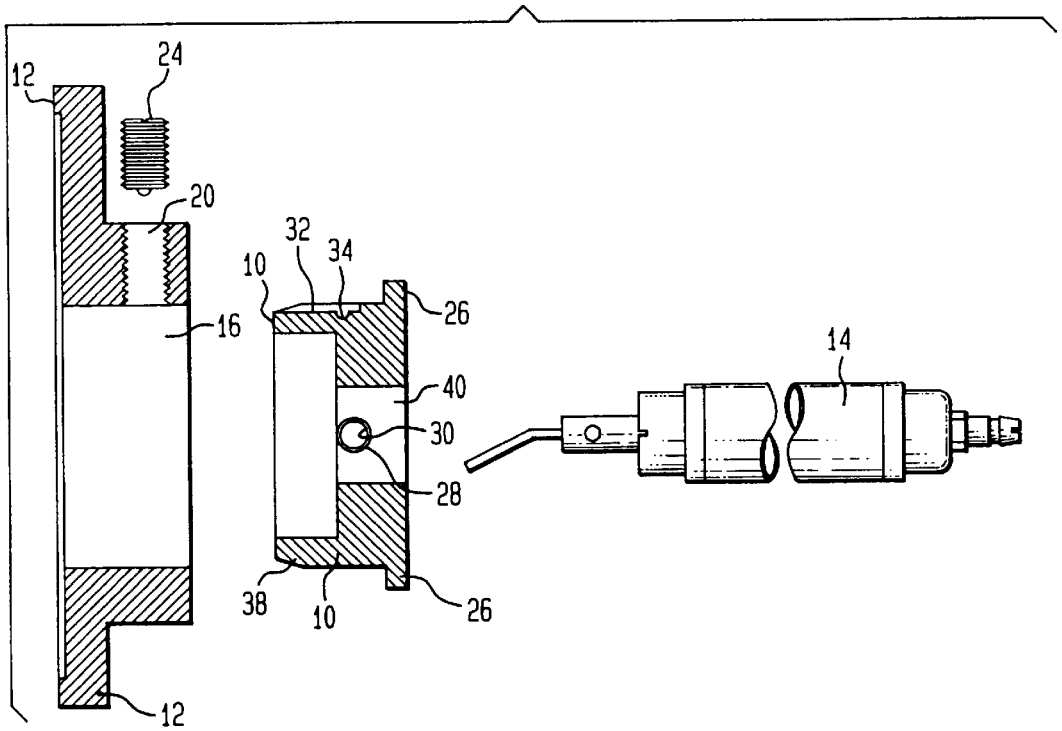
FIG. 3. illustrates a cross sectional view of the preferred embodiment.

FIG. 3 illustrates a cross sectional view of the bushing 10, burner mounting plate 12, and the electrode 14. To improve versatility, aperture 40 is large enough to accommodate any standard size electrode. Set screw 30 may be adjusted to secure the electrode 14 regardless of its length and diameter. Recesses, 34 located at the end of keyways 32, allow ball plungers 24 to pop in or pop out to secure the bushing 10 in place. Ball plungers 24 allow bushing 10 to be inserted or removed with out any special tools. The pop-in and pop-out action allows for the smooth insertion and removal of bushing 10 and igniter electrode 14. Bushing 10 and burner mounting plate 12 are easily fabricated from cast iron.

Figure 4:
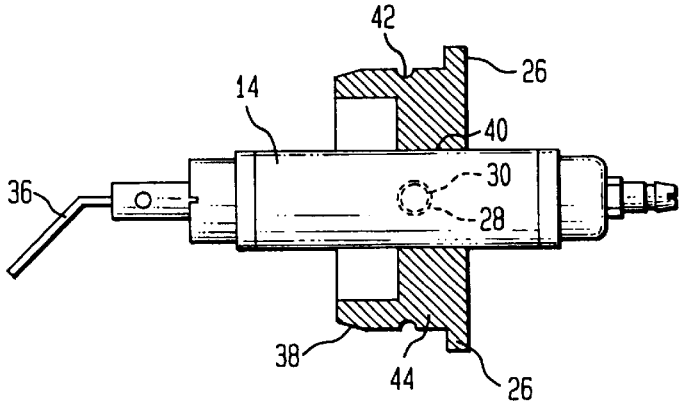
FIG. 4. illustrates a cross sectional view of an alternative embodiment.

FIG. 4 illustrates an alternative embodiment 44. In the alternative embodiment 44 a circumferential groove 42 replaces keyways 32 and ball recesses 34. The alternative embodiment 44 allows the use of straight tipped electrodes by allowing the bushing to rotate freely once popped into the burner mounting plate 12. The insertion process is similar to that of the preferred embodiment 10 except that the bushing 10 has no keyways to line up with the ball plungers 24. Instead, the bushing 10 is simply pushed into burner mounting plate aperture 16 until the ball plungers pop into the circumferential groove 42. Rim 26 prevents over-travel of the bushing 10. The bushing alternative embodiment 44 is now securely held in position in the burner mounting plate 12 and is free to rotate.

Figure 5:
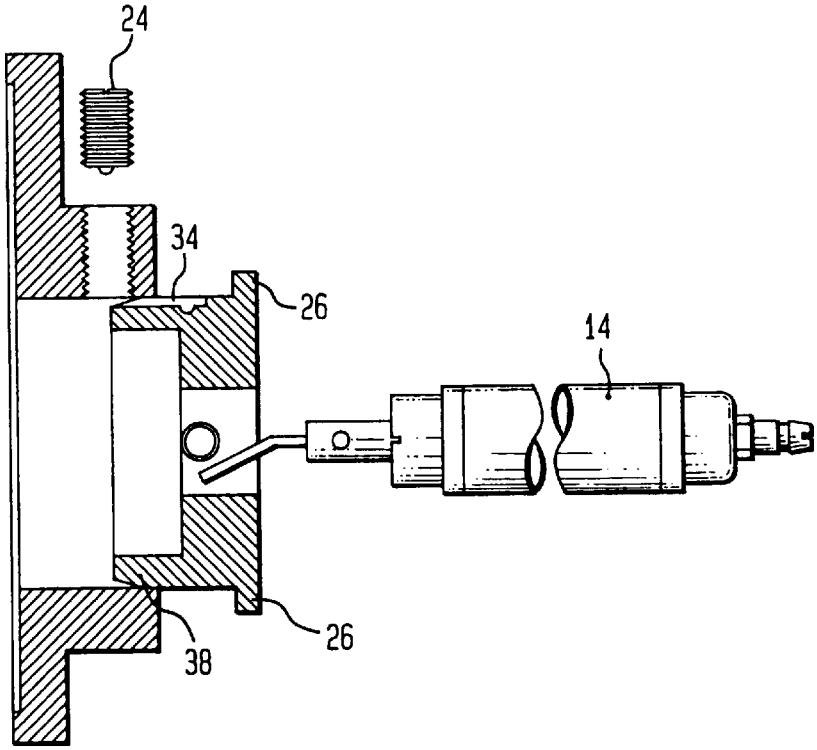
FIG. 5. illustrates a cross sectional view of the preferred embodiment.

FIG. 5 illustrates the bushing assembly 10 partially mated to the burner mounting plate 12. The shoulder 38 of the bushing assembly 10 has made contact with the inner wall of the burner plate aperture 16. Ball plungers 24 have engaged keyway slots 32. The circumference of the bushing assembly 10 is within the burner aperture 16. Tension from the compressed springs of the ball plungers 24 is communicated to the bushing assembly 10 through the balls at the end of the ball plungers 24. The tension from the ball plungers 24 aids in mating bushing assembly 10 to burner plate 12, because the tension allows for smooth feeding of the bushing assembly 10 while preventing the bushing assembly 10 from falling out of the burner mounting plate 12.

Figure 6:
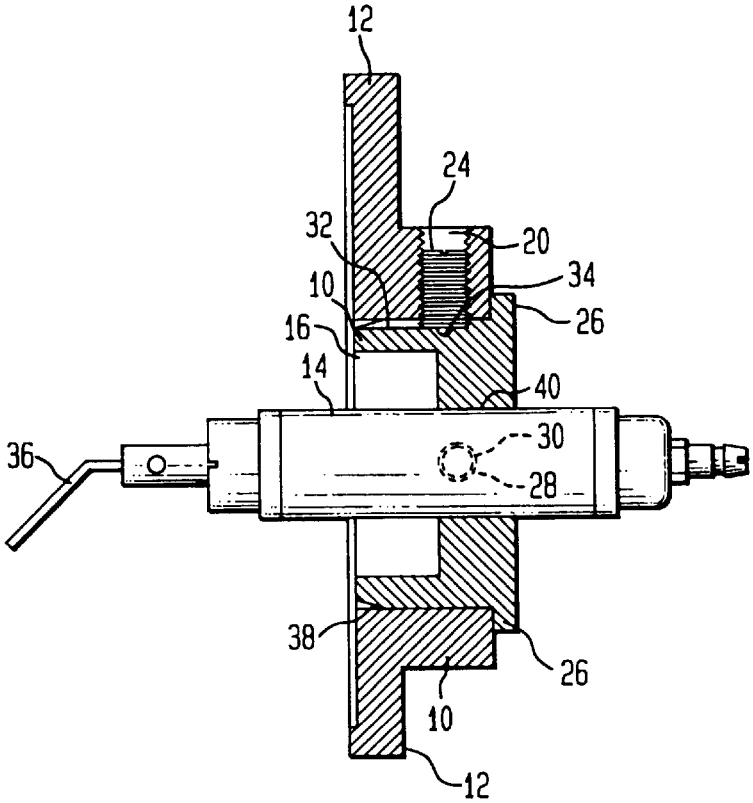
FIG. 6. illustrates a cross sectional view of the preferred embodiment.

FIG. 6 illustrates how bushing assembly 10 mates with burner plate 12. The cross-sectional side view illustrates aperture 16 in burner plate 12. The igniter electrode 14 is first fed through aperture 40. The bushing 10, which is attached to electrode 14, follows the igniter electrode 14 into the aperture 16. The shoulder 38 of bushing 10 makes contact with the face of burner plate 12 and guides the feeding of bushing 10 in to the aperture 16. The shoulder 38 makes contact with the edge of the aperture 16 when bushing 10 begins to center in the aperture 16 as forward motion is applied to bushing 10. Bushing 10 is then rotated or aligned until the keyways 32 line up with the ball plungers 24. Once aligned, forward motion may be applied. Ball plungers 24 guide the bushing 10 through the keyway slots 32 which are located on the exterior wall of the bushing 10. As the ball plungers 24 reach the end of the keyway slots 32 they pop into ball recesses 34. Ball recesses 34 are located at the end of the keyway slots 32. The bushing 10 is now securely held in position in the burner mounting plate 12.

The invention just described has several distinct advantages over prior art devices. First, the invention is easy to operate. With no skill and very little effort the electrodes can be popped in or out whenever desired. Second, the invention allows for exact positioning of the electrode tip 36 with repeatability. Finally, the igniter electrode bushing with the pop in and out feature allows installation, removal, inspection, and replacement of igniter electrodes without any tools or use of special electrodes.

While the invention has been described with reference to the preferred embodiment thereof, it will be appreciated by those of ordinary skill in the art that modifications can be made to the structure and elements of the invention without departing from the spirit and scope of the invention as a whole.

What is claimed is:

1. An electrode installation apparatus for inserting and releasably securing a burner electrode within an aperture of a gas burner plate, said apparatus comprising:

an annular bushing having a cavity for receiving said electrode and an outer surface configured for insertion into said burner plate aperture, said outer surface of said bushing and the surface defining said burner plate aperture being similarly configured for relatively close mutual engagement whereby said bushing and said burner plate are located relative to one another;

first means for rigidly securing said electrode within said cavity of said bushing whereby said electrode and said bushing are movable together as a single unit;

a cavity on said outer surface of said annular bushing opening toward the surface defining said aperture in said burner plate when said bushing is located within said aperture of said burner plate;

a cavity within said aperture of said burner plate opening toward said cavity on the outer surface of said bushing when said bushing is located within said aperture of said burner plate;

a ball like member located within said cavity of said burner plate and configured to engage said cavity on said outer surface of said bushing; and, a spring within said cavity of said burner plate interposed between said burner plate and said ball like member to bias said ball like member away from said burner plate into said cavity on said outer surface of said bushing when said bushing is located within said aperture of said burner plate and thereby releasably retain said bushing and said burner plate relative to one another, wherein said annular bushing and electrode can be manually pushed into said aperture of said burner plate and releasably secured thereto by said ball like member and manually pulled out of said aperture of said burner plate against the force of said spring for ease of removal and cleaning.

2. The apparatus of claim 1 wherein said first means comprises:

a channel in said bushing, said channel having threads therein; and, a set screw located in said threaded channel, wherein said bushing is attachable to said electrode by advancing said set screw along said threaded channel until it contacts said electrode when said electrode is surrounded by said bushing.

3. The apparatus of claim 2 wherein:

said channel in said bushing and said related set screw are covered by a portion of said burner plate when said bushing is releasably secured within said burner plate.

4. The apparatus of claim 1 wherein:

said cavity in said burner plate is defined by a threaded passage; and, said ball like member and said spring are part of a ball plunger in threaded engagement with said threaded passage.

5. The apparatus of claim 1 wherein:

said cavity on said outer surface of said bushing is defined by a ball recess; and, said annular bushing includes a key way terminating at said ball recess and configured to engage said ball like member therein whereby movement of said bushing and said burner plate relative to one another will be in particular alignment as a result of engagement of said ball like member in said key way.

6. The apparatus of claim 1 wherein said cavity in said outer surface of said bushing is defined by an annular circumferential groove for selectively engaging said ball like member.

7. The apparatus of claim 1 wherein:

said bushing includes a plurality of said cavities on said outer surface;

said burner plate includes a plurality of cavities within said aperture, each cavity having a ball like member and a spring; and, said cavities on said bushing and said cavities in said burner plate are in alignment when said bushing is located within said aperture of said burner plate whereby said ball like members releasably secure said burner plate and said bushing relative to one another.

* * * * *